US010018317B2

(12) United States Patent
Taudt et al.

(10) Patent No.: US 10,018,317 B2
(45) Date of Patent: Jul. 10, 2018

(54) LIGHTING DEVICE FOR A MOTOR VEHICLE HEADLAMP

(71) Applicant: ZKW Group GmbH, Wieselburg (AT)

(72) Inventors: Lukas Taudt, Wieselburg (AT); Josef Plank, Purgstall/Erlauf (AT)

(73) Assignee: ZKW GROUP GMBH, Wieselburg (AT)

( * ) Notice: Subject to any disclaimer, the term of this patent is extended or adjusted under 35 U.S.C. 154(b) by 0 days.

(21) Appl. No.: 15/564,372

(22) PCT Filed: Jul. 18, 2016

(86) PCT No.: PCT/AT2016/060008

§ 371 (c)(1),
(2) Date: Oct. 4, 2017

(87) PCT Pub. No.: WO2017/015684

PCT Pub. Date: Feb. 2, 2017

(65) Prior Publication Data

US 2018/0128443 A1 May 10, 2018

(30) Foreign Application Priority Data

Jul. 28, 2015 (AT) ..... A 50672/2015

(51) Int. Cl.
*F21V 9/00* (2018.01)
*F21S 41/24* (2018.01)
(Continued)

(52) U.S. Cl.
CPC ..... *F21S 41/24* (2018.01); *F21S 41/141* (2018.01); *F21S 41/285* (2018.01); *F21Y 2115/10* (2016.08)

(58) Field of Classification Search
USPC ..... 362/511, 509
See application file for complete search history.

(56) References Cited

U.S. PATENT DOCUMENTS 5,727,108 A 3/1998 Hed
8,011,803 B2 9/2011 Cheung et al.
(Continued)

FOREIGN PATENT DOCUMENTS

DE 10231326 A1 2/2004
DE 10318952 A1 11/2004
(Continued)

OTHER PUBLICATIONS

Austrian Search Report issued in application No. A 50672/2015, completed Jun. 10, 2016 (1 page).
(Continued)

*Primary Examiner* — Vip Patel
(74) *Attorney, Agent, or Firm* — Eversheds Sutherland (US) LLP

(57) ABSTRACT

The invention relates to a lighting device (1) for a headlamp, in particular a motor-vehicle headlamp, comprising a plurality of light sources (100), a light-guiding device (10) with a plurality of light-guiding elements (11, 12, 13), and a downstream imaging optical element (200), wherein each light-guiding element (11, 12, 13) has a light infeed face and a light exit face, wherein the light-guiding elements (11, 12, 13) are arranged in at least one row, wherein the light-guiding elements of at least one row are configured as main beam light-guiding elements (11) and form a main beam row, wherein each main beam light-guiding element (11) comprises a lower light-guiding face (24), wherein the lower light-guiding face (24) has, at least in the region in which the light beams (52) are reflected, structures (25) at least in regions.

9 Claims, 6 Drawing Sheets

Figure 1:
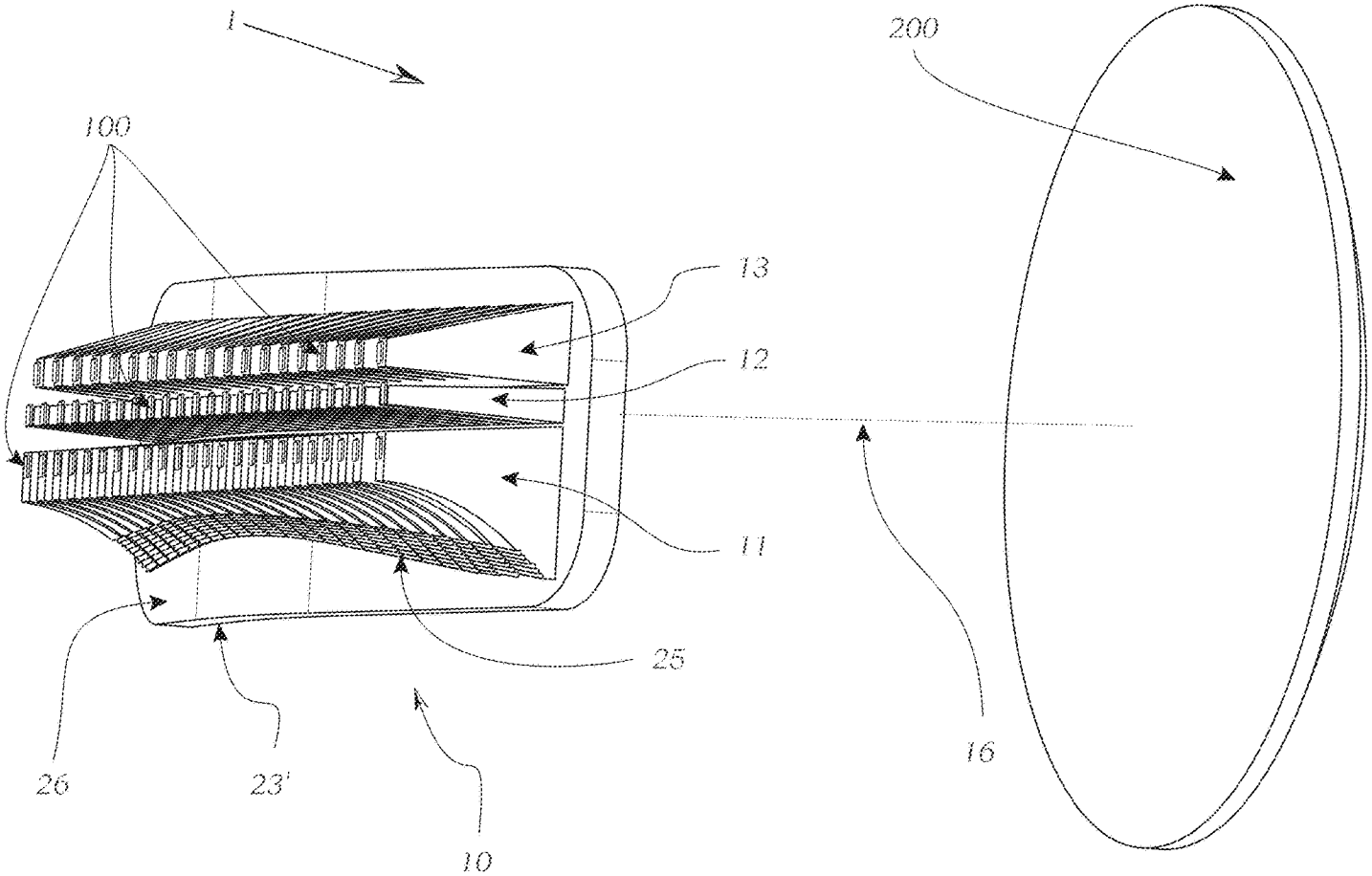

(51) Int. Cl.

| | |
|---|---|
| ***F21S 41/141*** | (2018.01) |
| ***F21S 41/20*** | (2018.01) |
| *F21Y 115/10* | (2016.01) |

(56) References Cited

U.S. PATENT DOCUMENTS

| | | | |
|---|---|---|---|
| 2015/0131324 | A1 | 5/2015 | de Lamberterie |
| 2015/0167913 | A1 | 6/2015 | Stefanov et al. |

FOREIGN PATENT DOCUMENTS

| | | | |
|---|---|---|---|
| DE | 102008005488 | A1 | 7/2009 |
| DE | 102009053581 | B3 | 3/2011 |
| DE | 102010027322 | A1 | 1/2012 |
| DE | 102012211284 | A1 | 1/2014 |
| EP | 2378187 | A1 | 10/2011 |
| EP | 2587125 | A2 | 5/2013 |
| EP | 2743565 | A1 | 6/2014 |

OTHER PUBLICATIONS

International Search Report for PCT/AT2016/060008, dated Oct. 14, 2016 (3 pages).

LIGHTING DEVICE FOR A MOTOR VEHICLE HEADLAMP

The invention relates to a lighting device for a headlamp, in particular a motor vehicle headlamp, comprising a plurality of light sources, a light-guiding device with a plurality of light-guiding elements, and a downstream imaging optical element, wherein each light-guiding element has a light input face and a light exit face, wherein the light-guiding elements are arranged in at least one row.

Lighting units of this type, which are also referred to as pixel light modules, are customary in vehicle construction and by way of example serve for the imaging of glare-free main beam, in that the light is generally radiated from a plurality of artificial light sources and is bundled by a corresponding plurality of adjacently arranged light guides (optical attachment/primary optics) in the radiation direction. The light guides have a relatively small cross-section and therefore emit the light of the individual light sources assigned to them in a very concentrated manner in the radiation direction. Pixel light headlamps are very flexible in respect of the light distribution, since the illumination intensity can be individually controlled for each pixel, i.e. for each light guide, and any desired light distributions can be realised.

On the one hand, the concentrated radiation of the light guides is desired, for example in order to comply with legal requirements relating to the light-dark line of a motor vehicle headlamp or in order to provide adaptive flexible masking scenarios, and on the other hand disruptive inhomogeneities form in regions of the light pattern in which a uniform, concentrated and directed lighting is desired, for example in the case of the main beam distribution.

This problem could be improved by reducing the height of the main beam distribution, however this is contrary to customer requirements. There is thus a need for improved measures for homogenising the main beam distribution.

Various measures and methods are known from the prior art which on the one hand are based on defocusing and on the other hand on light scattering, for example by means of light-scattering structures.

Document U.S. Pat. No. 8,011,803 B2 relates to a fog headlamp which comprises collimating optical attachments with attached corrugated deflection face, which is inclined relative to the primary radiation direction of the LED. On the one hand, the light is thus deflected, but also scattered, so that the homogeneity is improved.

Document DE 2009 053 581 B3 relates to the primary optics of a matrix/pixel module. The end exit face of the optics is provided with a corrugated pad structure.

Document DE 10 2008 005 488 A1 discloses a fine-structured face for the optical unit with a plurality of structural elements, by means of which the light flecks are widened in the horizontal direction. With superimposition of the light flecks, the edges disappear, thus resulting in a more homogeneous overall light distribution.

Document DE 10 2010 027 322 A1 describes refractive micro-optical components on the light exit surface of a primary optics.

Document EP 2 587 125 A2 discloses microstructures on the light exit face of the primary optics of a pixel headlamp.

Document U.S. Pat. No. 5,727,108 discloses prismatic delimiting faces for a compound parabolic concentrator (CPC) optical attachment.

The object of the invention is to create a lighting device for headlamps that on the one hand enables a more homogeneous main beam distribution and on the other hand enables a concentrated and directed lighting of a main beam region.

This object is achieved with a lighting device for headlamps of the type mentioned in the introduction, which is characterised in accordance with the invention in that the light-guiding elements of at least one row are configured as main beam light-guiding elements and form a main beam row, wherein each main beam light-guiding element comprises a lower light-guiding face, wherein the lower light-guiding face, at least in the area in which the light beams are reflected, has structures at least in regions.

The invention constitutes a technically simple and economical measure for locally influencing the light distribution in the respective main beam light-guiding elements and therefore for providing a more homogeneous main beam distribution.

The basic structure of light-guiding elements and optical attachments for pixel light lighting devices for headlamps is known per se. The light-guiding elements are produced for example from plastic, glass, or any other materials suitable for guiding light. The light-guiding elements are preferably produced from a silicone material. The light-guiding elements are typically embodied as solid bodies and preferably consist of a single continuous optical medium, wherein the light is guided within this medium. The light-guiding elements typically have a substantially square or rectangular cross-section and usually widen in the light radiation direction, in a manner known per se. In an alternative embodiment, the light-guiding elements can be realised as open collimators.

These structures are advantageously formed in the region of the lower light-guiding face that borders the light exit face and in which the light is reflected. By arranging the structures only in the vicinity of the light exit face of the respective main beam light-guiding elements of the main beam row, in particular the superimposition of reflected light beams and the directly radiated light can thus be improved.

The light radiated from the light source and coupled into the light-guiding element is expediently totally reflected by the lower light-guiding face.

The structures formed on the lower light-guiding face advantageously comprise structural elements that have a periodic geometry.

It has been found that it is particularly advantageous if the structures are formed in a rib-like manner, wherein the ribs are oriented transversely to an optical axis of the lighting device.

The ribs can have a width of approximately 0.1 to 0.4 mm and a height of 0.015 to 0.03 mm.

In a variant, it is provided that, starting from the light exit face, 6 to 15 ribs are formed in the lower light-guiding face.

According to experience, the structure of a lighting device for pixel light headlamps is particularly efficient if the light-guiding elements are arranged in exactly three rows arranged one above the other, which together form a main beam distribution. With an arrangement of this type, the upper row can be formed as a forefield row, the middle row can be formed as an asymmetry row, and the lower row can be formed as a main beam row, wherein the main beans formed of main beam light-guiding elements is provided with structures as disclosed and described herein. The lowermost row is expediently the main beam row.

In another embodiment, all light-guiding elements can be formed as main beam light-guiding elements, which are arranged in exactly one row. Lighting devices of this type are also referred to as pixel main beam modules.

The light-guiding elements of the rows are preferably arranged as closely to one another as possible, whereby inhomogeneities in the light pattern can be reduced once again. In a development of the invention, the light exit faces of the individual light-guiding elements can therefore be part of a joint light exit face, wherein the individual light exit faces border one another. The joint light exit face is typically a curved face, which usually follows the Petzval face of the imaging optics (for example an imaging lens). For specific applications, however, deliberate deviations can be inserted in the curvature in order to utilise imaging errors in the edge region for light homogenisation.

A further subject of the invention relates to a headlamp, in particular a motor vehicle headlamp, which comprises a lighting device according to the invention as disclosed herein. Headlamps of this type are also referred to as pixel light headlamps.

Figure 2:
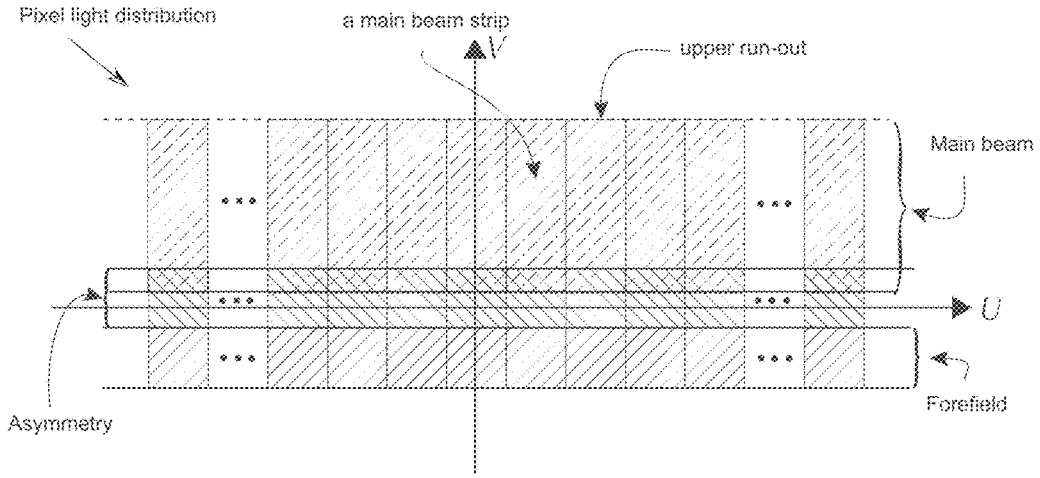
Figure 3:
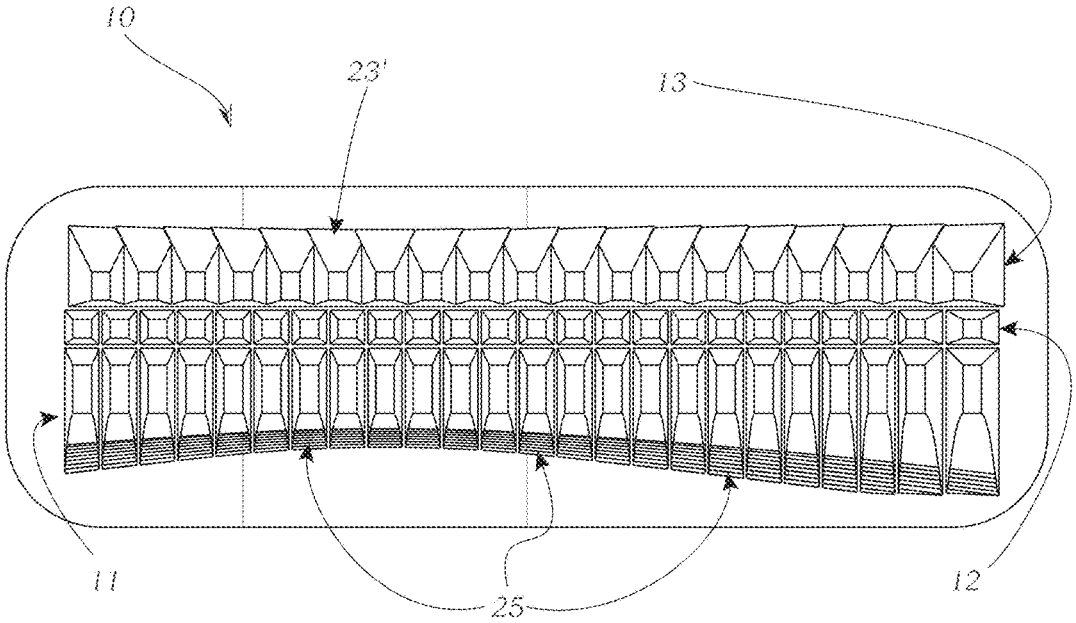
Figure 4:
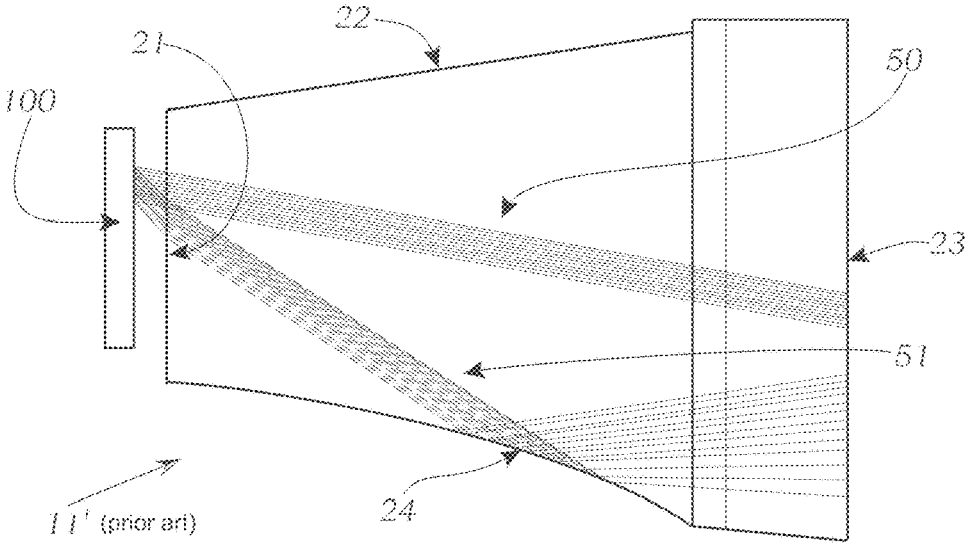
Figure 5:
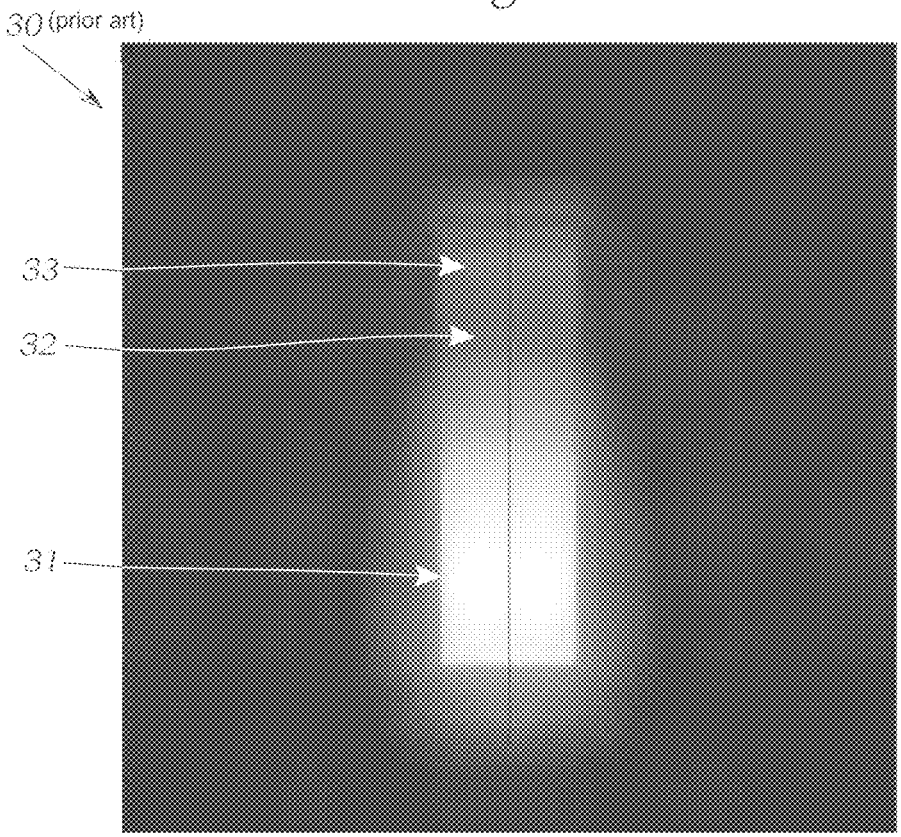
Figure 6:
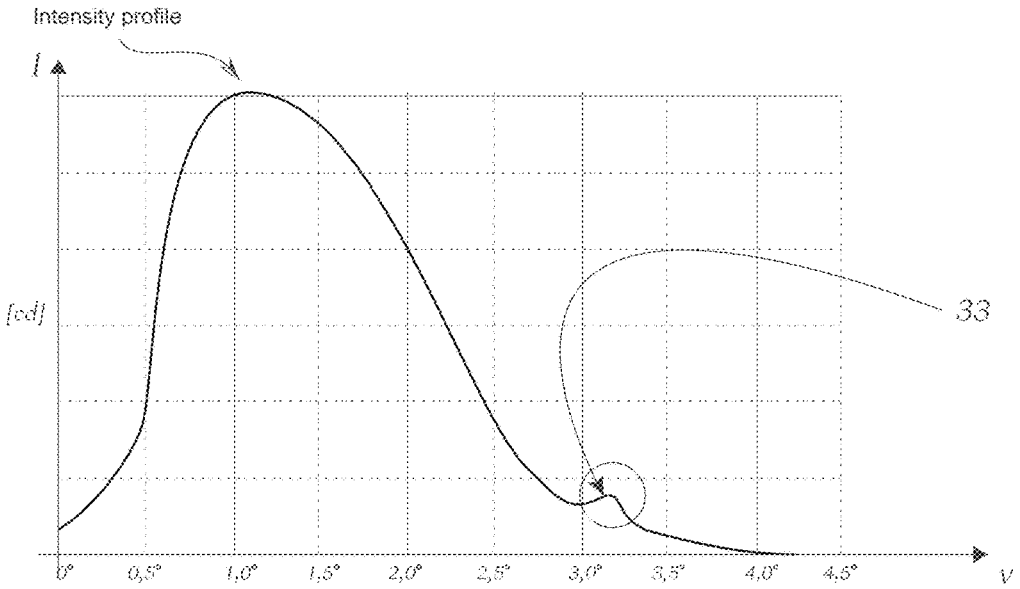
Figure 7:
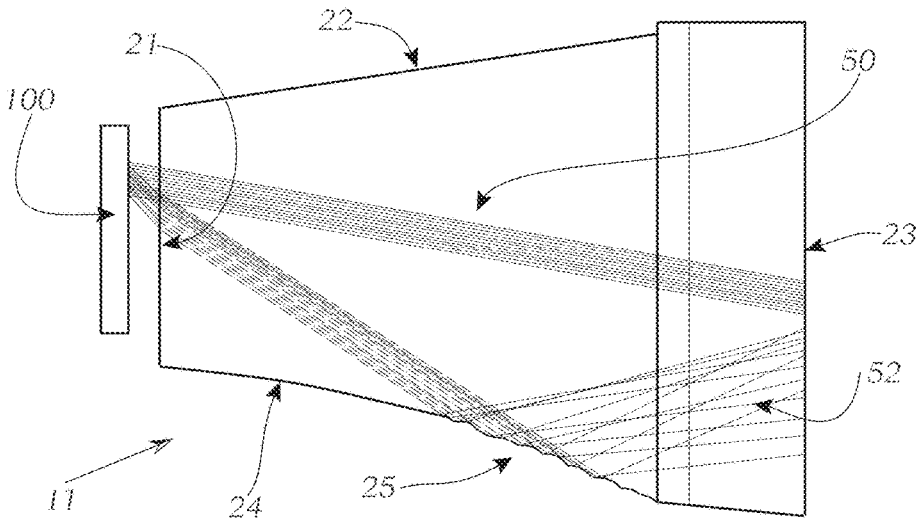
Figure 8:
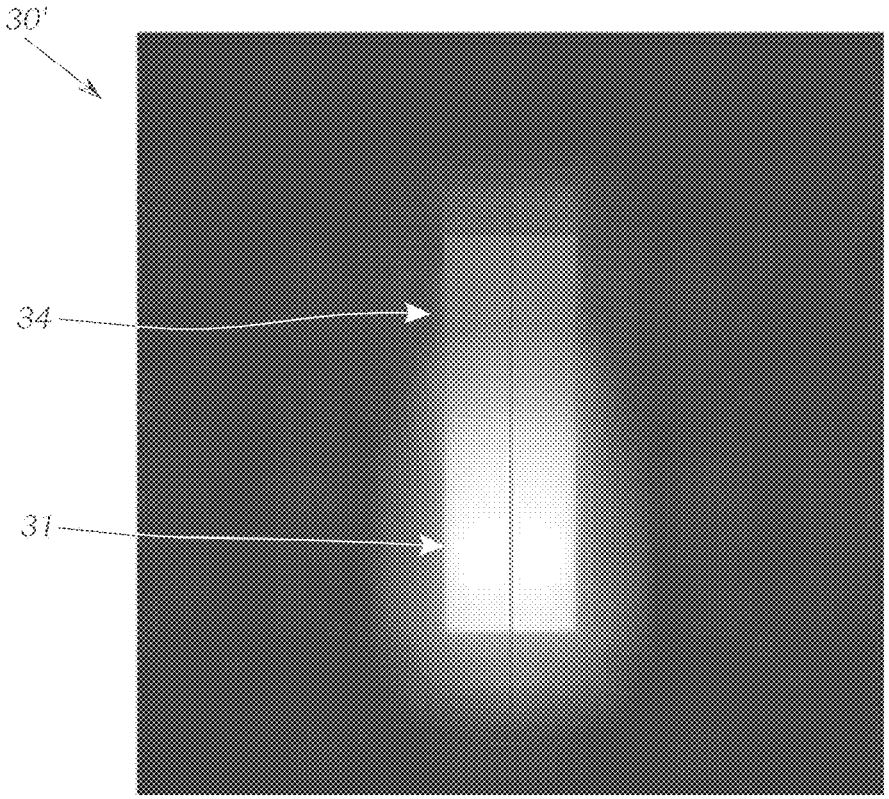
Figure 9:
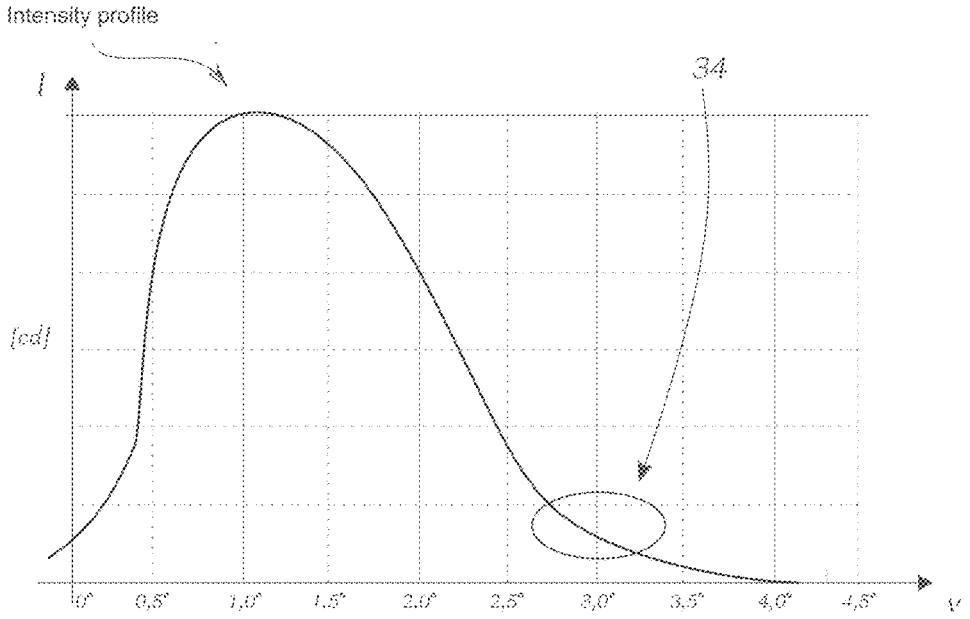
Figure 10:
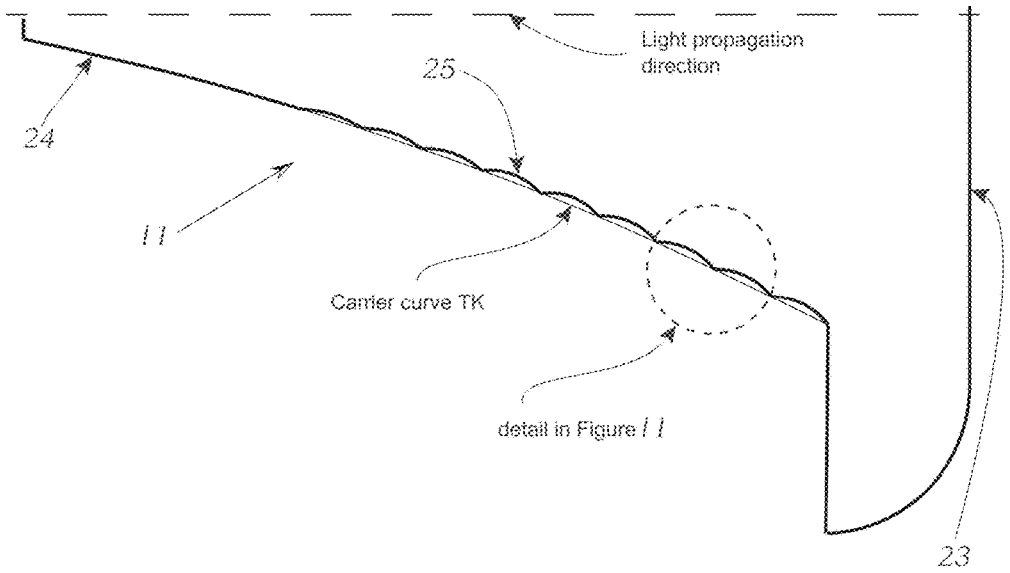
Figure 11:
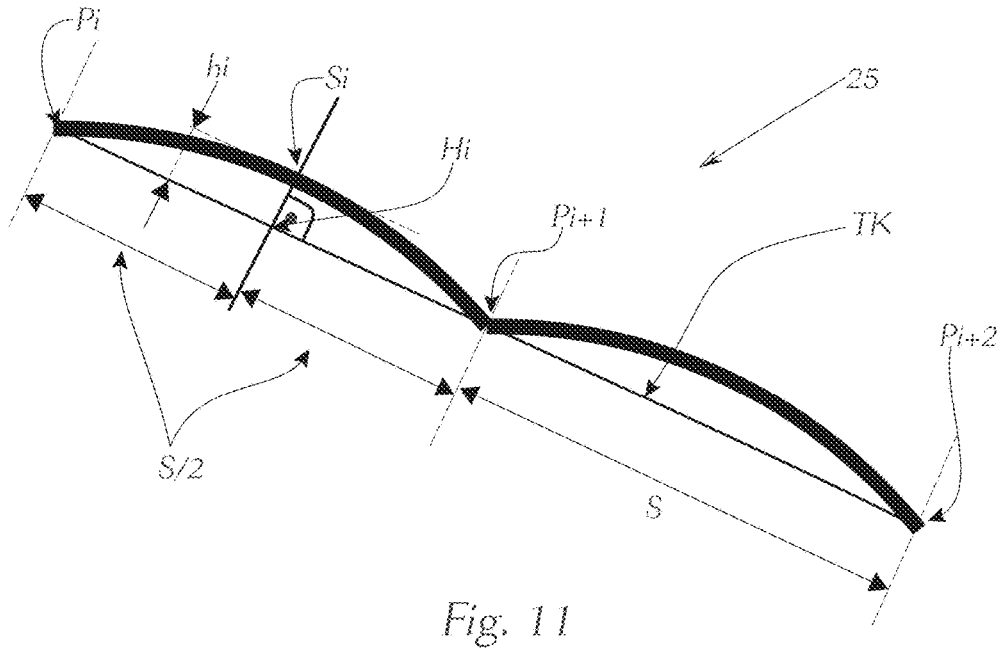

The invention and advantages thereof will be described in greater detail hereinafter on the basis of non-limiting examples, which are illustrated in the accompanying drawings. The drawings show, in:

FIG. 1 a perspective illustration of the basic structure of a lighting device according to the invention, FIG. 2 an illustration of the total light distribution obtained with the lighting device from FIG. 1, FIG. 3 a detailed view of an optical attachment from FIG. 1 in the light propagation direction, FIG. 4 a side view of a main beam light-guiding element according to the prior art, FIG. 5 a light intensity distribution (light intensity simulation) of a main beam light-guiding element from FIG. 4, FIG. 6 an intensity profile curve of the light intensity distribution from FIG. 5, FIG. 7 a side view of a main beam light-guiding element according to the invention, FIG. 8 an illustration of the light intensity distribution of the main beam light-guiding element from FIG. 7, FIG. 9 an intensity profile curve of the light intensity distribution from FIG. 8, FIG. 10 a vertical section through a main beam light-guiding element according to the invention, and FIG. 11 a detail from FIG. 10.

FIG. 1 shows a perspective illustration of the basic structure of a lighting device 1 according to the invention. The lighting device 1 comprises a plurality of LED light sources 100, not illustrated in greater detail in FIG. 1 (but see FIG. 7 for further details), and an optical attachment 10 (=primary optics) positioned in the light radiation direction, and a downstream imaging optics 200 (illustrated as an individual lens 200). The optical attachment 10 comprises light-guiding elements 11, 12, 13, which are arranged in three rows and which extend on the radiation side to a joint end plate 26. The end plate 26 is delimited on the radiation side by a light exit face 23', wherein the light exit faces 23 of the individual light-guiding elements (see FIG. 7) are each part of the joint light exit face 23', wherein individual light exit faces 23 border one another. The joint light exit face 23' is typically a curved face, which usually follows the Petzval face of the imaging lens 200. For specific applications, deliberate deviations in the curvature of the joint light exit face 23' can also be inserted in order to utilise imaging errors in the edge region for light homogenisation. Each light-guiding element 11, 12, 13 is assigned an LED light source 100 (see FIG. 7) in a manner known per se. The lighting intensity can be individually controlled for each light-guiding element 11, 12, 13, and therefore any desired light distributions can be realised. In the case of the optical attachment 10 shown in FIG. 1, the upper row is configured as a forefield row consisting of a plurality of forefield light-guiding elements 13. The middle row is configured as an asymmetry row consisting of a plurality of asymmetry light-guiding elements 12, and the lower row is configured as a main beam row consisting of a plurality of main beam light-guiding elements 11. The three rows in the activated state together form a main beam distribution. The main beam light-guiding elements 11 are provided on their lower light-guiding face 24 (see FIG. 7 in this respect) with a rib structure 25, wherein the ribs 25 are oriented transversely to an optical axis 16 of the lighting device 1. FIG. 3 shows a detailed view of the optical attachment 10 from FIG. 1 in the light propagation direction.

The light-guiding elements 11, 12, 13 can be produced for example from silicone, plastic, glass, or any other materials suitable for guiding light. The light-guiding elements 11, 12, 13 are embodied as solid bodies and consist of a single continuous optical medium, wherein light is guided within this medium. The light-guiding elements 11, 12, 13 have a substantially square or rectangular cross-section and widen in the light radiation direction, where they ultimately extend on the radiation side to a joint end plate 26, as described above, which is delimited on the radiation side by a light exit plane 23' (see FIG. 3).

FIG. 2 shows an illustration of the total light distribution (=pixel light distribution) as viewed through the imaging lens on a measuring screen that can be obtained with the lighting device 1 from FIG. 1. Therein, fields arranged in three rows in a matrix-like manner around a horizontal axis U and a vertical axis V can be seen, wherein the upper row, which comprises a plurality of main beam strips, serves to light the main beam region, the middle row serves to light in the asymmetry region (formation of the light-dark boundary), and the lower row serves to light the forefield of a pixel light headlamp. On the whole, the light distribution forms a main beam distribution. Adjacently arranged fields contact one another or overlap one another, whereby the light pattern appears substantially homogeneous to an observer.

FIG. 4 shows a side view of a main beam light-guiding element 11' according to the prior art. The main beam light-guiding element 11' is a solid body with a light input face 21, via which the light radiated from the LED light source is coupled into the light-guiding element 11'. The light is guided forwards along the main beam light-guiding element 11' to a light exit face 23. FIG. 4 also shows exemplary beam paths starting from the light input face 21, wherein the beams 50 represent the direct light exit and the beams 51, which are reflected on a lower light-guiding face 24, represent the indirect light exit. The upper light-guiding phase 22 can also be seen, whereas the light-guiding faces laterally delimiting the solid bodies are not provided with reference signs for reasons of clarity. The light beams are totally reflected at the light-guiding faces. As can be clearly seen from FIG. 4, the lower light-guiding face 24 of a main beam light-guiding element 11' is formed in accordance with the prior art along its entire length as a smooth reflection face (optimised for use for total reflection).

FIG. 5 shows, by way of example, a light intensity distribution 30 (light ray tracing simulation with a light intensity sensor, wherein a grey-scale image, corresponding to the light intensity, is obtained) of a main beam light-guiding element 11' from FIG. 4. In the lower region of the main beam segment, an intensity maximum 31 can be defined; in the upper region of the main beam segment, there is by contrast firstly an intensity drop 32, which leads, due to a counterincrease 33 in the intensity, to a clearly visible inhomogeneity. FIG. 6 shows an intensity profile curve of the light intensity distribution from FIG. 5, in which the counterincrease 33 can be clearly seen. The reason for the modularity lies in particular in the transition and defective overlap between the directly radiated light 50 and the light 51 reflected at the lower light-guiding face 24.

FIG. 7 shows a side view of a main beam light-guiding element 11 according to the invention. The main beam light-guiding element 11 according to the invention differs from that from the prior art (main beam light-guiding element 11', see FIG. 4) in that rib-like structures 25 are formed on the lower light-guiding face 24 in the region in which the beams 52 are reflected. The rest of the structure of the main beam light-guiding element 11 corresponds to that from FIG. 4, and reference is made to the description further above in this regard. FIG. 7 also shows exemplary beam paths starting from the light infeed face 21, wherein the beams 50 represent the direct light exit and the beams 52, which are reflected at the rib structure 25 of the light-guiding face 24, represent the indirect light exit. The rib structure 25 scatters and shapes the light 52 precisely in the region lying in the transition between the directly radiated light 50 and the light 52 reflected at the rib structure 25 of the lower light-guiding face 24. The light distribution can be influenced by the rib structure 25, consequently resulting in an improvement of the light homogeneity.

FIG. 8 shows, by way of example, a light intensity distribution 30' (light ray tracing simulation with a light intensity sensor, wherein a grey-scale image, corresponding to the light intensity, is obtained) of a main beam light-guiding element 11 according to the invention from FIG. 7. In the lower region of the main beam segment, the intensity maximum 31 can be defined; in the upper region of the main beam segment, a continuous drop in the intensity can generally be seen, and the light pattern is much more homogeneous compared to the prior art. FIG. 9 shows an intensity profile curve of the light intensity distribution from FIG. 8, from which the continuous intensity drop and the improved homogeneity (marked in FIG. 7 by the reference sign 34) in the transition between the directly radiated light 50 and the light 52 reflected at the rib structure 25 can be clearly seen. With the aid of the rib structure, the run-out upwardly (see FIG. 2) can be better designed or optimised.

FIG. 10 shows a vertical section through a main beam light-guiding element 11 according to the invention. As can be seen therein, the ribs 25 extend transversely to the optical axis (or light propagation direction) and along a (virtual) carrier curve TK on the lower light-guiding phase 24. In the shown example, a total of 9 ribs are formed starting from the light exit face 23. The ribs 25 for example have a width of 0.3 mm and a height of 0.015 to 0.03 mm.

FIG. 11 shows a detail from FIG. 10 (shown in FIG. 10 by a dashed circle). An optimised embodiment can be obtained as follows: The carrier curve TK is, here, the delimitation of a light-guiding element. Points P (Pi, Pi+1, Pi+2) are plotted on this curved (virtual) curve TK, which points have a constant distance S from one another. This distance (or wavelength) is for example S=0.30 mm for a specific main beam light-guiding element. Adjacent points Pi and Pi+1 define a path, at the midpoint Hi of which a normal is established. An apex point Si is established above the point at a distance=amplitude of hi. The three points Pi, Si, Pi+1 are the grid points of a spline curve. The magnitude of the amplitude is iteratively varied, and a light-based simulation is performed in a manner known per se with the corresponding geometry. By comparison of the obtained light patterns (or of the gradient profile), the best amplitude is determined. This procedure must be repeated for each rib, since the distance from the light source (LED light source 100) defines the angle of incidence on the carrier curve and therefore the position of the inhomogeneity. The delimiting face of the rib itself is an extraction face of the determined spline curve, wherein the extraction direction is normal to the vertical middle plane of the light-guiding element, and wherein each rib has its own amplitude.

The shown examples are just some of many, and are not to be interpreted as limiting.

The invention claimed is:

1. A lighting device (1) for a motor-vehicle headlamp, comprising:

a plurality of light sources (100);

a light-guiding device (10) with a plurality of light-guiding elements (11, 12, 13); and a downstream imaging optical element (200), wherein each of the light-guiding elements (11, 12, 13) has a light infeed face and a light exit face, wherein the light-guiding elements (11, 12, 13) are arranged in at least one row and the light-guiding elements of at least one row are configured as main beam light-guiding elements (11) and form a main beam row, wherein each main beam light-guiding element (11) comprises a lower light-guiding face (24), wherein the lower light-guiding face (24) has, at least in the region in which the light beams (52) are reflected, structures (25) at least in regions, wherein the structures (25) are formed in the region of the lower light-guiding face (24) which borders the light exit face (23) and in which the light is reflected, and wherein the structures are rib-like, wherein the ribs (25) are oriented transversely to an optical axis (16) of the lighting device and have a width of 0.2 to 0.4 mm and a height of 0.015 to 0.03 mm.

2. The lighting device according to claim 1, wherein the lower light-guiding face (24) totally reflects the coupled-in light beams.

3. The lighting device according to claim 1 wherein the ribs have a periodic geometry.

4. The lighting device according to claim 1, wherein, starting from the light exit face, 6 to 15 ribs (25) are formed on the lower light-guiding face (24).

5. The lighting device according to claim 1, wherein the light-guiding elements (11, 12, 13) are arranged in exactly three rows arranged one above the other, which together form a main beam distribution.

6. The lighting device according to claim 5, wherein the lowermost row (11) is the main beam row.

7. The lighting device according to claim 1, wherein all light-guiding elements are formed as main beam light-guiding elements arranged in exactly one row.

8. The lighting device according to claim 1, wherein the light exit faces (23) of the light-guiding elements (11, 12, 13) are part of a joint light exit face (23'), wherein individual light exit faces (23) border one another.

9. A motor-vehicle headlamp comprising a lighting device (1) according to claim 1.

* * * * *